US007594412B1

(12) United States Patent
Dren

(10) Patent No.: US 7,594,412 B1
(45) Date of Patent: Sep. 29, 2009

(54) REFRIGERATING APPLIANCE

(75) Inventor: Dejan Dren, Sentjur (SI)

(73) Assignee: Gorenje gospodinjski aparati, d.d. (SI)

( * ) Notice: Subject to any disclaimer, the term of this patent is extended or adjusted under 35 U.S.C. 154(b) by 364 days.

(21) Appl. No.: 11/721,306

(22) PCT Filed: Nov. 14, 2005

(86) PCT No.: PCT/SI2005/000034

§ 371 (c)(1),
(2), (4) Date: Jun. 8, 2007

(87) PCT Pub. No.: WO2006/062488

PCT Pub. Date: Jun. 15, 2006

(30) Foreign Application Priority Data

Dec. 8, 2004 (SI) ..... P-200400338

(51) Int. Cl.
*F25C 1/00* (2006.01)

(52) U.S. Cl. ..... 62/340; 62/419; 62/441

(58) Field of Classification Search ..... 62/340, 62/414, 419, 440–441
See application file for complete search history.

(56) References Cited

U.S. PATENT DOCUMENTS 2,792,691 A * 5/1957 Murphy et al. ..... 62/155
3,005,321 A * 10/1961 Devery ..... 62/186
3,243,972 A * 4/1966 Wiese ..... 62/414
4,768,353 A * 9/1988 Bushser ..... 62/408
5,546,759 A * 8/1996 Lee ..... 62/441
6,532,751 B1 3/2003 Schenk et al.

FOREIGN PATENT DOCUMENTS

| | | |
|---|---|---|
| DE | 94 22 078 U1 | 11/1997 |
| EP | 0 036 238 A2 | 9/1981 |
| GB | 1 394 946 A | 5/1975 |
| JP | 4-263771 A | 9/1992 |

OTHER PUBLICATIONS

International Search Report for parent application PCT/SI2005/000034, having a mailing date of Feb. 16, 2006.

* cited by examiner

*Primary Examiner*—William E Tapolcai
(74) *Attorney, Agent, or Firm*—Andrus, Sceales, Starke & Sawall, LLP

(57) ABSTRACT

The present invention refers to a refrigerating appliance preferably for cooling of drinks, comprising a cooling section with a freezing unit arranged therein having a freezing section where an ice making device is arranged, said cooling section and/or freezing section being optionally divided into several compartments by means of partition walls, and having an evaporator for creating and supplying cold air into the freezing section and cooling section, where several cooling channels are formed in a body of the refrigerating appliance for distributing cooling air via several discharging slots into each separate compartment.

5 Claims, 4 Drawing Sheets

REFRIGERATING APPLIANCE

CROSS-REFERENCE TO RELATED APPLICATIONS

This application is the U.S. national stage application of International Application PCT/SI2005/000034, filed Nov. 14, 2005, which International Application was published on Jun. 15, 2006, as International Publication No. WO 2006/062488 A1 in the English language. The International Application claims priority of Slovenian Patent Application P-200400338, filed Dec. 8, 2004.

BACKGROUND

The present invention refers to a refrigerating appliance, preferably for cooling drinks, comprising a cooling section with a freezing unit arranged therein, having a freezing section where an ice making device is arranged, said cooling and/or freezing section being optionally divided into several compartments by means of partition walls, and having an evaporator for creating and supplying cold air into the freezing and cooling section, where several cooling channels are formed in the body of the refrigerating appliance for distributing cooling air via several discharging slots into each separate compartment.

The aforementioned refrigerating appliance comprising a cooling section with an ice making device arranged therein is well known, where an insulated body is inserted in the cooling section in which there is located an ice making device, an evaporator, and a fan arranged above said evaporator, said fan forcing cooled air over the ice making device. The drawback of the aforementioned solution is that the forced cooling air circulation in the cooling section is not satisfactory resulting in relatively high temperature gradients in the cooling section. There also exists a constant danger of moisture precipitation and/or ice creation on the walls dividing the cooling section from the ice making device which are not insulated or not insulated enough, respectively.

SUMMARY

It is the object of the present invention to create a refrigerating appliance where the cooling section is fed by a cooling air without fear that the foodstuff placed in the cooling section freezes locally, and where minimal temperature gradients are obtained in said cooling section.

The object as set above is solved according to the invention by a vertical partition wall made of material having a good thermal conductivity, said partition wall being arranged in a cooling section and spaced from a back of the refrigerating appliance and extending over the entire free inner surface of said back. Thus, a channel for cooling air flow is created between said back and said partition wall. Said channel is conveniently divided in two vertical channels separated by means of a vertical web, where the first channel is intended to supply cooling air into the cooling section, and the second channel is intended to draw the air to an evaporator. Said vertical partition wall is formed in each compartment provided in the cooling section and in the area of the first vertical channel, with an array of suitable slots for supplying the cooling air into each compartment. Moreover, said vertical partition wall is formed, in the area of the second vertical channel, with an array of suitable slots for extracting the cooling air from the cooling section over the second vertical channel into the interspace between a freezing unit and the back of the refrigerating appliance where the evaporator is located. The freezing section is connected to the first vertical channel by means of a connecting channel, the aperture thereof can be opened and closed by means of a flap. The cooling air is blown into the cooling section and into the freezing section by means of a fan arranged in the partition wall which divides the evaporator from the freezing section. The air stream which is cooled down in the freezing section and which cools the ice making device returns through the slot in the partition wall that divides the evaporator from the freezing section into said interspace where the evaporator is located in order to be cooled down again.

In order to obtain as good cooling results as possible, the first vertical channel for supplying cooling air extends in height from the lowest compartment, with which it is connected, and up to the top of the refrigerating appliance, and in width, it extends approximately from the freezing unit to the body. The second vertical channel extends from the lowest compartment, to which it is connected, and up to the freezing unit, and in width, it extends for the width of the freezing unit.

In order to prevent freezing the drinks located directly by the vertical partition wall in the upper compartment, said vertical partition wall is lined with an insulation over the entire height of the channel in the area of entrance of the cold air stream into the first vertical channel and up to the discharging slots in the upper compartment. Thus, the possible freezing of drinks is prevented on one hand, and unwanted formation of water drops on the vertical partition wall on the other hand. According to the invention, said vertical partition wall is preferably made of metal. Furthermore, said slots for the entry of cooling air into the cooling section which are formed in said vertical partition wall are preferably arranged in the area of the outer wall of the refrigerating appliance.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
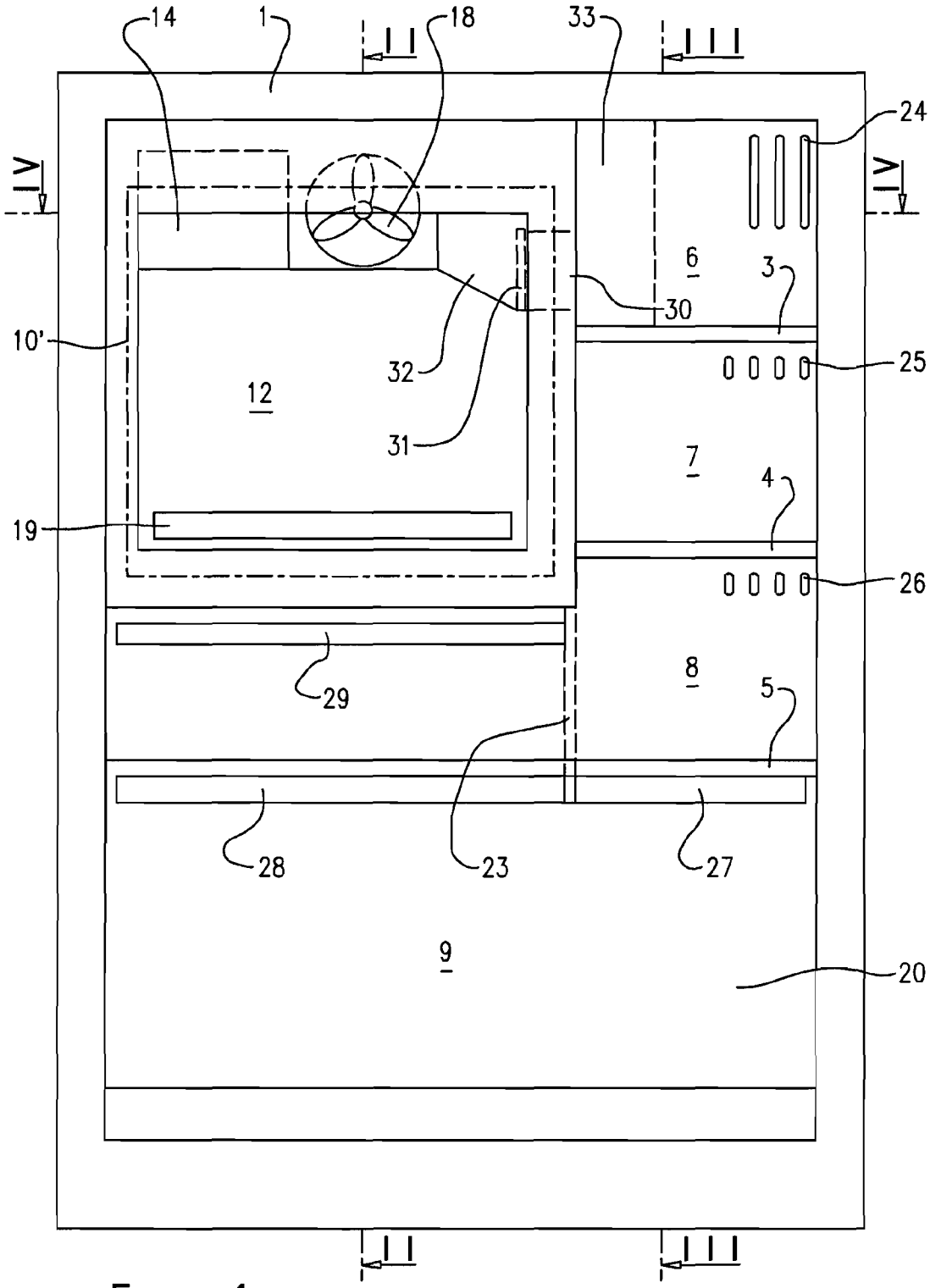
FIG. 1 a front view of a refrigerating appliance according to the invention, with the door removed.
Figure 2:
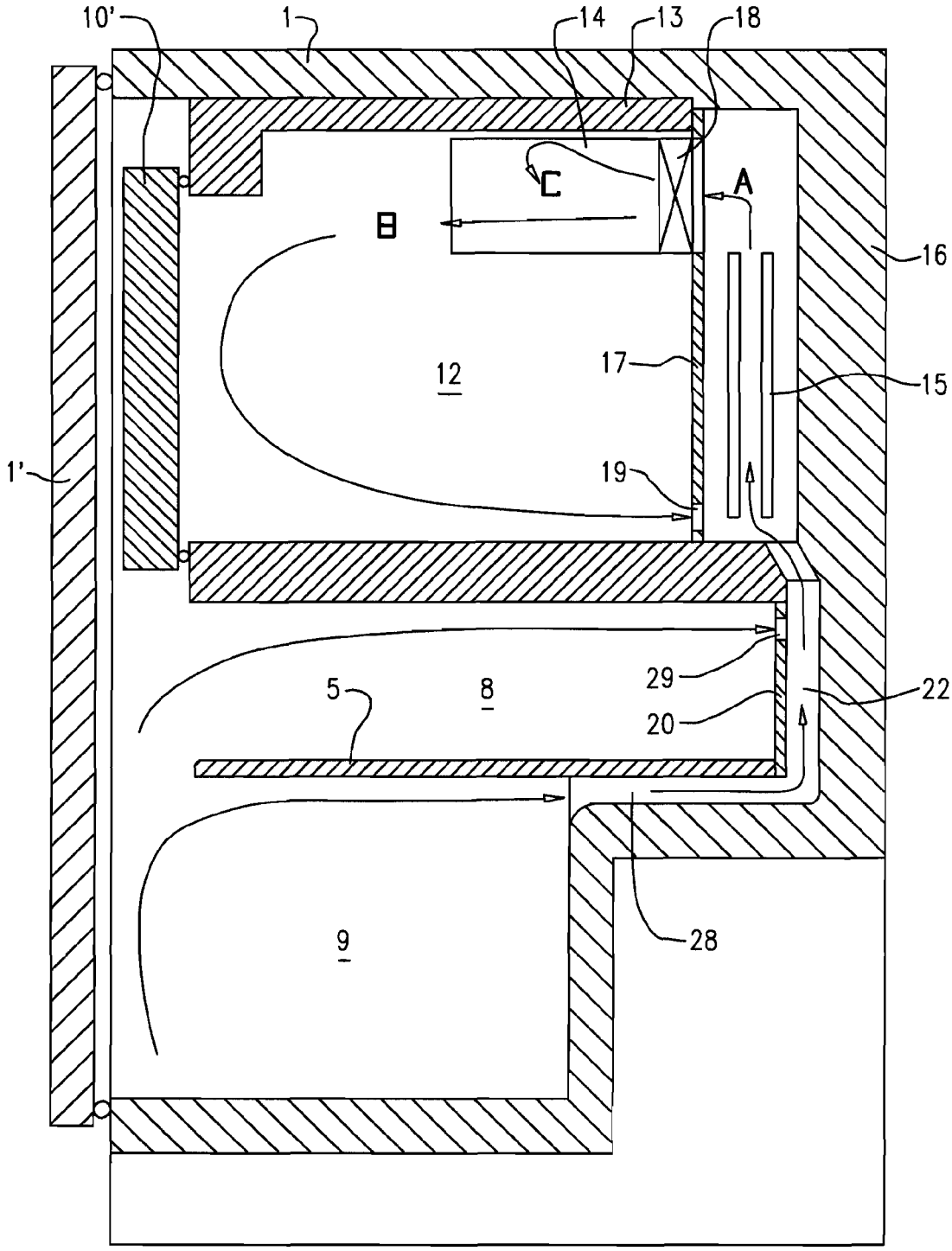
FIG. 2 a cross-sectional view of the refrigerating appliance along the line II-II of FIG. 1.
Figure 3:
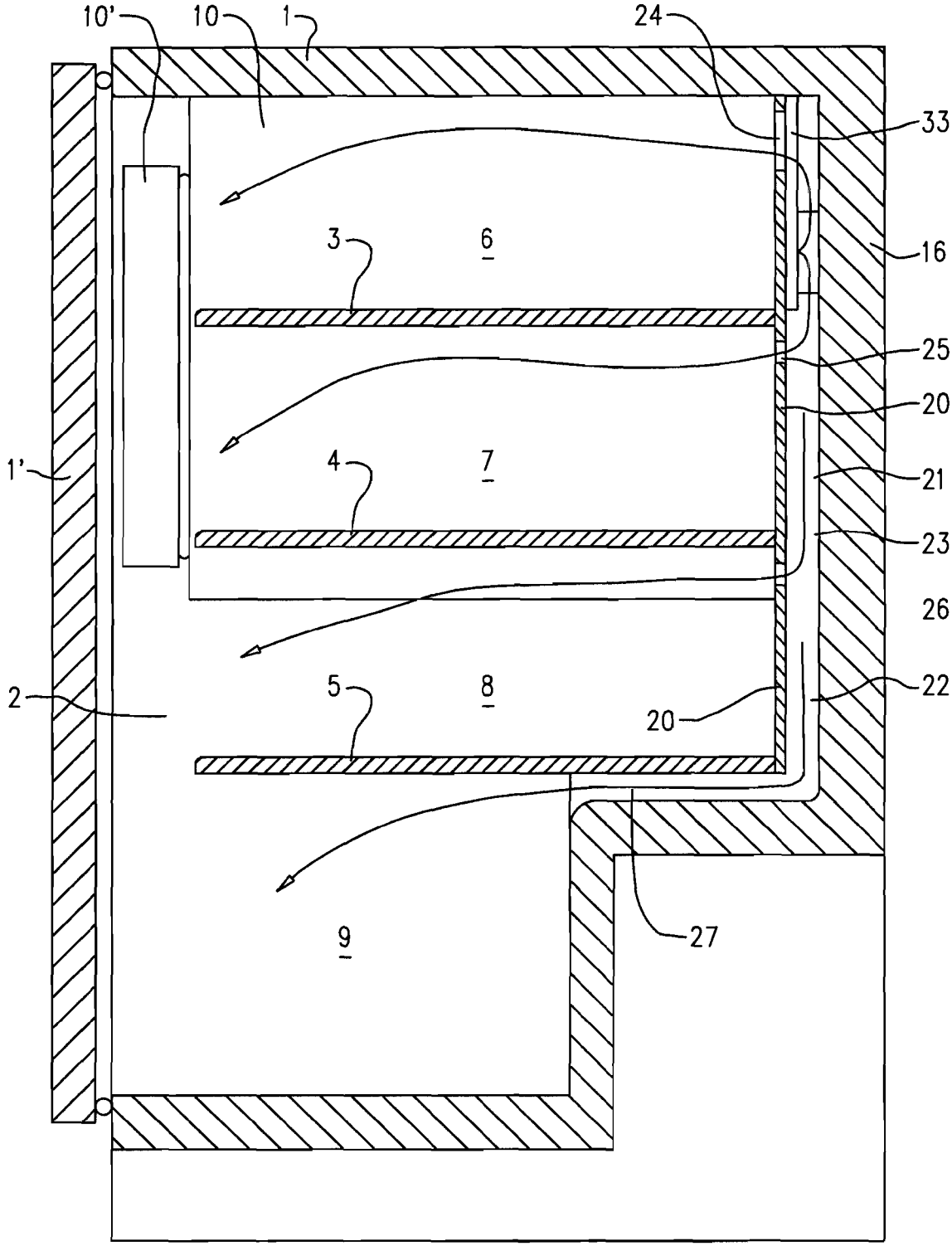
FIG. 3 a cross-sectional view of the refrigerating appliance along the line III-III of FIG. 1.

A refrigerating appliance according to the invention has a body 1 which is closed by a door 1' and comprises a cooling section 2 being optionally divided into several compartments 6, 7, 8, 9 by means of horizontal partition walls 3, 4, 5, and further comprises a freezing unit 10 arranged in the cooling section 2 and closed by a door 10' and comprising a freezing section 12 enclosed by means of a casing 11. Said partition walls 3, 4, 5 are intended for depositing and storing of food and/or drinks. Said freezing unit 10 is preferably arranged under the ceiling and by the wall of the cooling section 2. An ice making device 14 and an evaporator 15 for cooling down the cooling air are located in the freezing section 12 and directly under ceiling 13 of the freezing unit 10. Said evaporator 15 is arranged in the interspace between a back 16 of the refrigerating appliance and a vertical partition wall 17 in the freezing unit 10. Fan 18 is arranged in the upper area of the vertical partition wall 17 which divides the air stream A cooled down at the evaporator 15 into the air stream B flowing around the ice making device 14 and cooling down the freezing section 12 simultaneously and into air stream C which cools down the cooling section 2. After the ice making device 14 and the freezing section 12 are cooled down the cold air stream B returns through a slot 19 in the lower area of the partition wall 17 into said interspace where the evaporator 15 is located.

Figure 4:
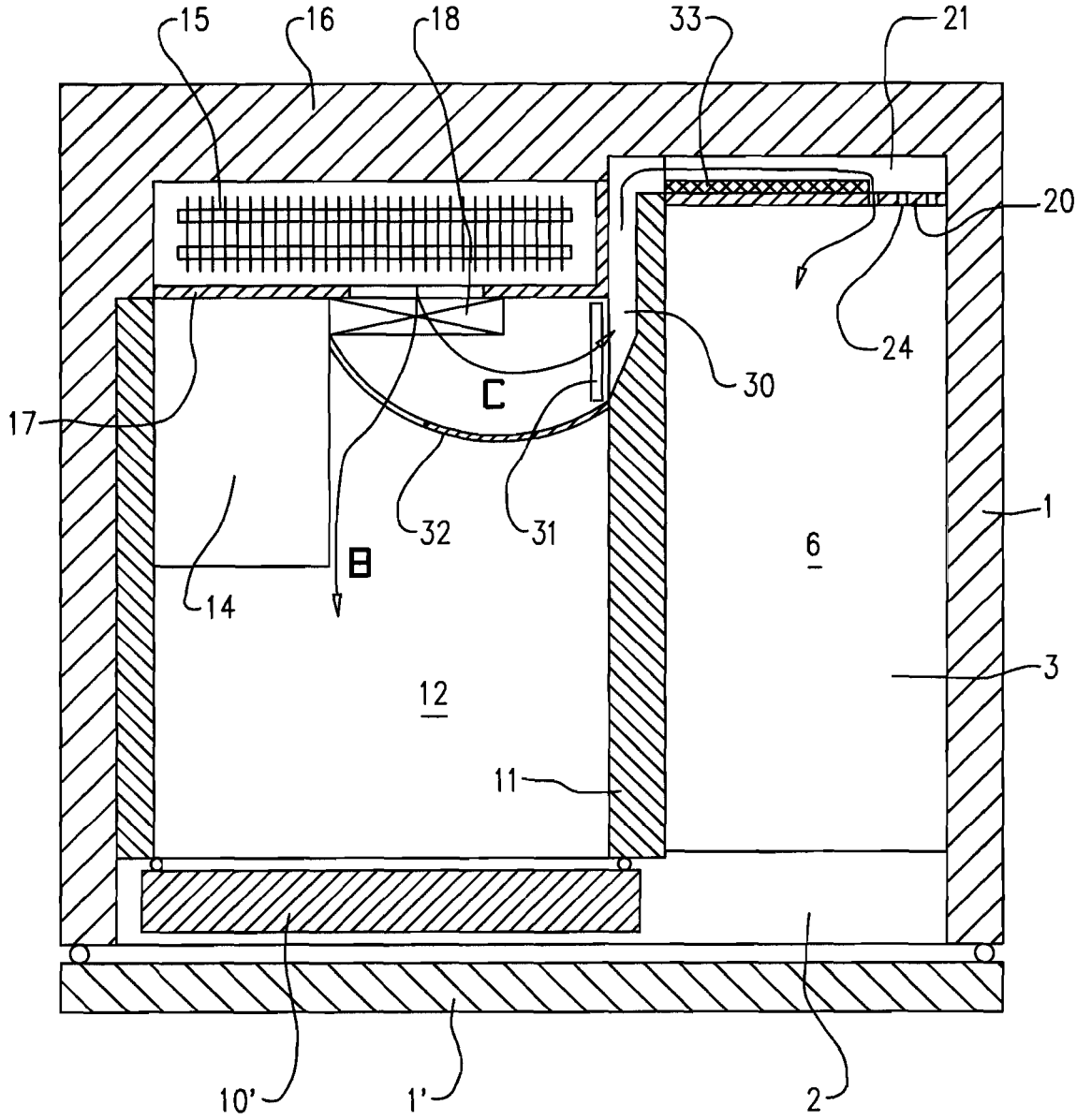
FIG. 4 a cross-sectional view of the refrigerating appliance along the line IV-IV of FIG. 1.

Horizontally spaced from the back 16 of the refrigerating appliance, there is arranged over the entire height a partition wall 20 made of a material with a good thermal conductivity, preferably of metal. In width, said partition wall 20 extends over the entire width of the refrigerating appliance only in the area under the freezing unit 10, whereas the width of said partition wall 20 equals, in the height of the freezing unit 10, only the distance between the freezing unit 10 and the body 1 (cf. FIG. 4). Thus, a channel for a cooling air flow is created between said back 16 and said partition wall 20, said channel being divided into two vertical channels 21, 22, mutually divided in width by means of a vertical web 23 extending from the freezing unit 10 to the area under the partition wall 5. The first vertical channel 21 extends in height from the lowermost compartment 9, with which it is connected, up to the top of the refrigerating appliance, and in width only from the freezing unit 10 to the body 1, whereas the second vertical channel 22 extends from the lowermost compartment 9, with which it is connected, up to the freezing unit 10, and in width only for the amount of the width of the freezing unit 10.

The partition wall 20 is formed in each compartment 6, 7, 8, 9 and in the area of the first vertical channel 21 with an array of respective slots 24, 25, 26, 27 for discharging of the cooling air into each compartment, whereas the partition wall 20 is formed in the area of the second vertical channel 22 with an array of respective slots 28, 29 for extracting the air. Here, each of said slots is preferably formed in the area directly under the partition wall 3, 4, 5. The freezing section 12 is connected by means of a connecting channel 30 to the first vertical channel 21, a flap being arranged at the aperture of the connecting channel 30, by means of which the amount of cold air is controlled which enters the vertical channel 21 from the freezing section 12. The amount of the air stream A is divided by means of a deflector 32 to the part B cooling down the freezing section 12, and the part C streaming through the connecting channel 30 into the first vertical channel 21, said deflector being arranged in the freezing unit 10 at the outlet side of the fan 18.

Thus, the cold air stream C passing through said flap 31 and the connecting channel 30 into the first vertical channel 21 travels downwards over said channel 21 and enters through said slots 24, 25, 26, 27 in each compartment 6, 7, 8, 9 of the cooling section 2 where it cools down the foodstuff located therein. In order to prevent in the upper compartment 6, freezing of the drinks located directly next to the partition wall 20, the latter is lined by means of an insulation 33 over the entire height of the channel 21 from the area of the cold air stream C entrance into the first vertical channel 21 to the discharging slots 24. The air stream cooling down the foodstuff flows between the door 1' of the refrigerating appliance and each partition wall 3, 4, 5 into the lowermost compartment 9, and from there, through the slots 28, 29 into the second vertical channel 22 and further into the interspace between the back 16 and the partition wall 17 where the evaporator 15 is located, where it joins the air stream B and cools down again, and afterwards the entire process repeats itself. According to the invention, it is preferable that the slots formed in said vertical partition wall 20 are located in the area of the outer wall of the refrigerating appliance. The temperature in the cooling section 2 and in the freezing unit 12, as well as the fan are controlled in a manner known per se and not shown in detail.

The invention claimed is:

1. A refrigerating appliance, for cooling drinks, comprising a cooling section with a freezing unit arranged therein having a freezing section where an ice making device is arranged, said cooling section and freezing section being divided into several compartments by means of partition walls, and having an evaporator for creating and supplying cold air into the freezing section and cooling section, where several cooling channels are formed in a body of the refrigerating appliance for distributing cooling air via several discharging slots into each separate compartment, characterized in that a partition wall is arranged in a cooling section and spaced from a back of a refrigerating appliance, said partition wall being made of a material with a good thermal conductivity and extending over the entire free inner surface of said back, thus, creating between said back and the partition wall a cooling air channel, the latter being divided into two vertical channels mutually separated by means of a vertical web, that said partition wall is formed in each compartment and in the area of the first vertical channel with an array of slots for supplying cooling air into each said compartment, whereas the partition wall is formed in the area of the second vertical channel with an array of respective slots for extracting the cooling air out of the cooling section over the channel into the interspace between a freezing unit and the back of the refrigerating appliance where an evaporator is located, and that a freezing section is connected with the first vertical channel by means of a connecting channel having an aperture which can be closed/opened by means of a flap, and via a slot with the interspace where the evaporator is located, where the cooling air is supplied into the cooling section and into the freezing section by means of a fan located on a partition wall dividing evaporator from the freezing section.

2. Refrigerating appliance according to claim 1, characterized in that the first vertical channel extends in height from the lowermost compartment, with which it is connected, to the top of the refrigerating appliance, and in width from the freezing unit to the body, whereas the second vertical channel extends in height from the lowermost compartment, with which it is connected, to the freezing unit, and in width approximately for the width of the freezing unit.

3. Refrigerating appliance according to claim 1, characterized in that the vertical partition wall is lined with an insulation in the area of the entering cold air stream into the first vertical channel and up to the outlet slots over the entire height of the channel.

4. Refrigerating appliance according to claim 1, characterized in that said partition wall is preferably made of metal.

5. Refrigerating appliance according to claim 1, characterized in that said entering slots formed in said vertical partition wall are arranged in the area of the outer wall of the refrigerating appliance.

* * * * *